US005441239A

United States Patent [19]

Watson

[11] Patent Number: 5,441,239

[45] Date of Patent: * Aug. 15, 1995

[54] ATTACHMENT DEVICE FOR CHAIN LINK FENCES

[76] Inventor: David Watson, 5987 Wiltshire Street, Vancouver, B.C., Canada, V6M 3L8

[ * ] Notice: The portion of the term of this patent subsequent to Aug. 30, 2011 has been disclaimed.

[21] Appl. No.: 188,786

[22] Filed: Jan. 31, 1994

Related U.S. Application Data

[63] Continuation-in-part of Ser. No. 108,444, Aug. 19, 1993, Pat. No. 5,342,021.

[51] Int. Cl.[6] ..... E04H 17/00

[52] U.S. Cl. ..... 256/1; 256/32; 40/622

[58] Field of Search ..... 256/1, 32; 40/489, 584, 40/611, 620, 622

[56] References Cited

U.S. PATENT DOCUMENTS 1,575,409 3/1926 Blaeser .
3,774,884 11/1973 Singer .
3,964,197 6/1976 Tucker .
4,505,061 3/1985 Neuburger et al. ..... 40/622
4,542,051 9/1985 Cirimele .
4,651,975 3/1987 Howell .
5,177,890 1/1993 Hisatomi .
5,342,021 8/1994 Watson ..... 256/1

*Primary Examiner*—Anthony Knight
*Attorney, Agent, or Firm*—Kent & Edgar

[57] ABSTRACT

A system for attaching a sign to a chain link fence of the type having post-supported interwoven wires producing a matrix of wire lengths extending between wire cross-over centers. The system comprises a sign, to the rear surface of which one or more attachment devices are secured. The attachment devices each comprise a pair of sections each having a face with circumscribing sides and interlocking means to secure the sections together along edges of their sides. The sections, when secured together over a cross-over center produce a hollow device having opposed faces and sides extending therebetween. The sides of the device have slots, when the device is so seated, located as to be seated over corresponding portions of the wire lengths extending outwardly from that center. A plurality of such devices supporting a sign, when secured to a chain link fence at predetermined locations, provide a simple and secure means for securing a sign to a chain link fence.

12 Claims, 3 Drawing Sheets

ATTACHMENT DEVICE FOR CHAIN LINK FENCES

This is a continuation-in-part of applicant's application Ser. No. 08/108,444 filed Aug. 19, 1993, now U.S. Pat. No. 5,342,021.

BACKGROUND OF THE INVENTION

The present invention relates to an attachment device for chain link fences, and more particularly relates to a plurality of such devices which may be secured to a chain link fence as a system of graphic elements to produce a decorative design or as supports for a sign or the like.

Chain link fences, of the type having post-supported interwoven wires producing a matrix of wire lengths extending between wire cross-over centers, are frequently used for fencing in areas for commercial, institutional (e.g. schoolyards), domestic, agricultural and other purposes. Such fences are not terribly attractive and have conventionally been "decorated" simply by painting the wire or wires a particular colour. The wires are normally spaced sufficiently far apart that lettering or designs painted on the fence would be unrecognizable. Hence the fences, when painted are normally in a single colour.

In U.S. Pat. No. 3,774,884 of Singer issued Nov. 27, 1973, a square plaque is taught which has deformable tabs at its periphery. These tabs are intended to be wrapped around the wires of a chain link fence so the plaque or plaques cover one or more of the mesh openings between the wires. U.S. Pat. No. 4,651,975 of Howell issued Mar. 24, 1987 describes and illustrates a system of grooved blocks of square configuration, with light wire connectors, the blocks to be installed onto the wires of the fence by way of the grooves and secured there by means of the wire connectors, thereby to close the openings in the mesh and provide privacy or wind protection.

It is an object of the present invention to provide an alternative construction of attachment device for a chain link fence which is economical to construct and simple to install. It is a further object of the present invention to provide such a device which will be difficult to tamper with, once installed on a chain link fence, and to a plurality of which devices or sign or the like, to be affixed to a chain link fence, may be secured.

SUMMARY OF THE INVENTION

In accordance with the present invention there is provided for such a chain link fence a system for attaching a sign. The system comprises one or more attachment devices, each comprising a pair of sections, each section having a face with circumscribing sides and interlocking means to secure the sections together along edges of their sides. The sections, when secured together over a cross-over center, produce a device with a hollow interior having opposed faces with sides extending therebetween. The sides of the device have slots, when the device is so seated, located so as to be seated over corresponding portions of the wire lengths extending outwardly from that center. The face of one of the sections of each of the devices is secured to a rear surface of a sign. When a plurality of such devices is used to attach a sign, the sections are secured to the rear surface of the sign relative to each other, so that each of the sections receives within its interior and side slots a cross-over center and wire length of a corresponding portion of the fence.

In a preferred embodiment of the present invention, the devices are secured to signs by way of an appropriate securing means such as screws, nuts and bolts, rivets or adhesive.

The system in accordance with the present invention is economical to construct and simple to install, to provide a sign securely attached to a chain link fence. Where, as in a preferred embodiment of the invention, the interlocking means are constructed and positioned so as to be within the hollow interior of the devices, the system is difficult to tamper with.

BRIEF DESCRIPTION OF THE DRAWINGS

These and other objects and advantages of the invention will become apparent upon reading the following detailed description and upon referring to the drawings in which.

Figure 1:
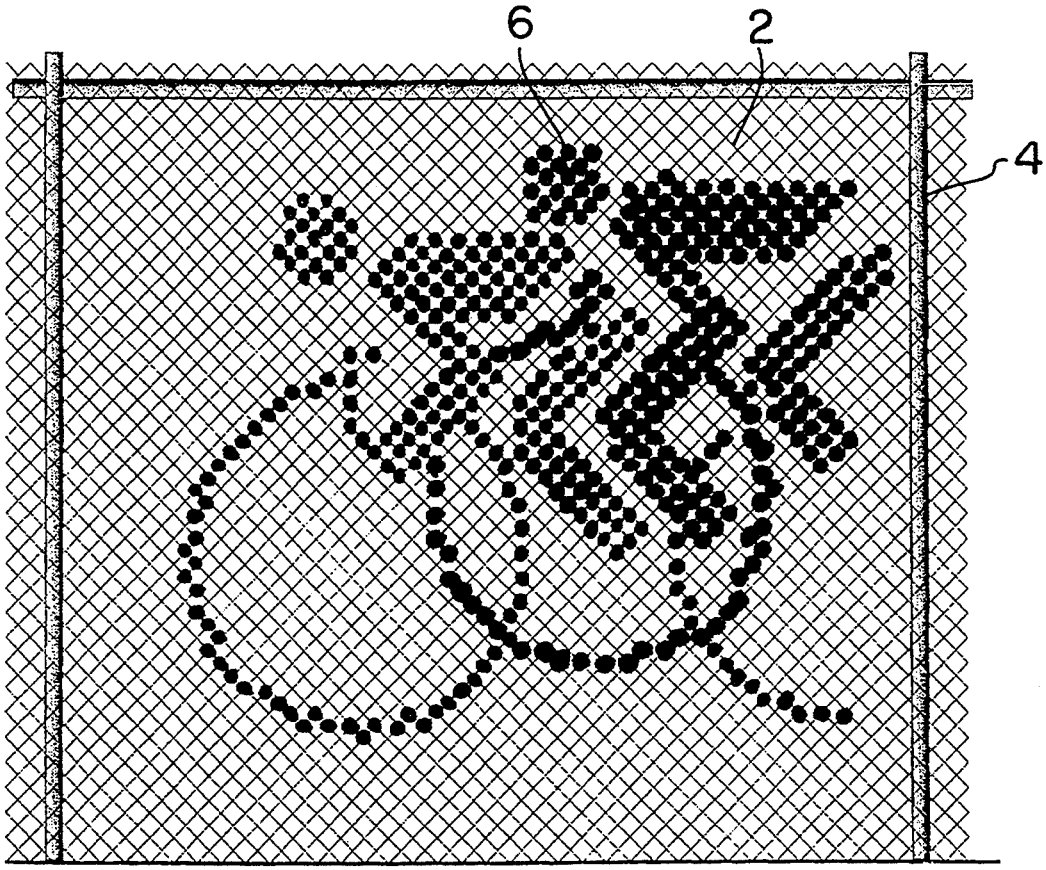
FIG. 1 is a plan view of a section of chain link fence on which a plurality of devices, in accordance with the present invention, have been installed to provide a graphic design.

While the invention will be described in conjunction with an illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to the drawings there is illustrated in FIG. 1, on a conventional chain link fence 2, supported by posts 4, a design created by a plurality of devices 6 in accordance with the present invention.

Figure 2:
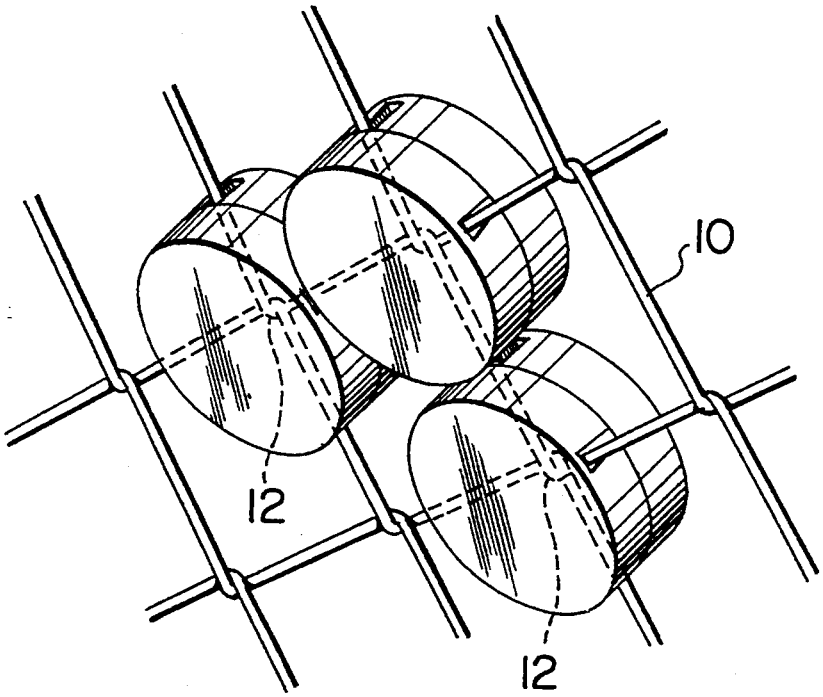
FIG. 2 is an enlarged view in perspective of a portion of the fence of FIG. 1, illustrating in more detail the location and positioning of the devices of the present invention thereon.
Figure 3:
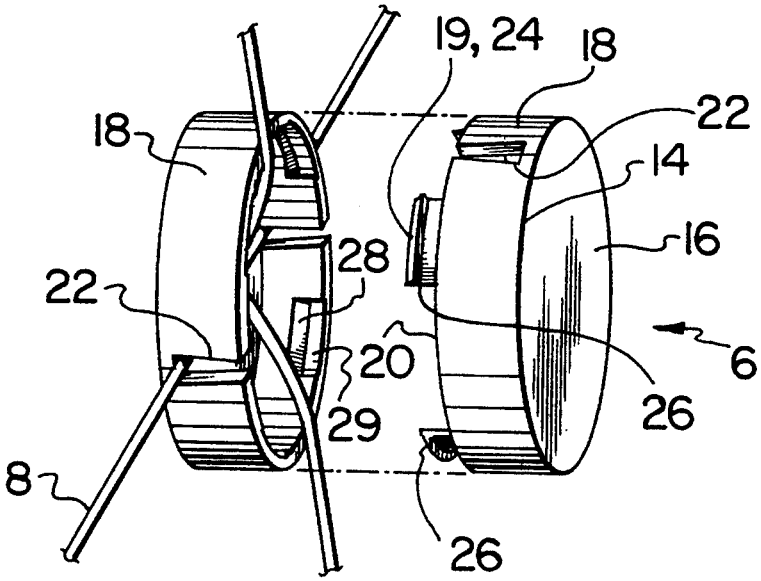
FIG. 3 is an exploded perspective view of a pair of sections which produce a device in accordance with the present invention on a chain link fence.

As can be seen more particularly in FIGS. 2 and 3, chain link fence 2 is formed by wires 8 which have been interwoven, as illustrated, to produce a matrix of wire lengths 10 extending between wire cross-over centers 12. It should be noted, particularly from FIG. 3, that each wire 8 "enters" and "departs" from each cross-over point 12 in a different plane, so that, in a sense, the chain link fence, when viewed in plan from above, has a thickness being the distance between the two planes in which the lengths 10 of each wire 8 sit.

In accordance with one aspect of the present invention, a plurality of devices 6 are secured at appropriate cross-over points 12. Each of the devices 6 comprises a pair of sections 14, in the illustrated embodiment of circular or disc-like configuration, having a face 16 and circumscribing sides 18. The sections 14 are each provided with appropriate interlocking means 19 so that they can be secured together along confronting edges 20 of sides 18 to produce a device 6 having a solid exterior appearance. When the sections 14 are secured together, each opposing face 16 is seated on an opposite side of fence 2, and the hollow interior of the device 6, thus produced, encloses a corresponding cross-over point 12 of wires 8 and portions of lengths 10.

Slots 22 are provided, at 180° opposed locations, in sides 18 of each section 14 as illustrated, through which corresponding lengths 10 of wire 8 may pass when the sections are in position on and over a cross-over point 12 on fence 2. The slots 22 of each section are, however, offset 90° with respect to the slots of the corresponding section 14 when in position, as will be understood from FIG. 3, since the lengths 10 on each "side" of fence 2, at a particular cross-over point 12 are similarly offset 90° with respect to the corresponding lengths 10, on the same wire 8, on the "other" side of the fence at that cross-over point. The depths of slots 22 are preferably such as to minimize lateral movement of the devices when the sections are secured together in position over a cross-over point on the fence.

As well, it will be understood from FIG. 3 that the distance between the inner surfaces of faces 16, when sections 14 are secured together on a cross-over point 16, must be at least as great as the "thickness" of the fence so that wires 8 will not obstruct the securing together of sections 14 at that location.

The interlocking means 19 are preferably formed so as to be hidden from view, when sections 14 are secured together, minimizing the ability of a person to tamper with the device when in position. In the illustrated embodiment, interlocking means 19 comprises a plurality of lugs 24 extending downwardly from an inner surface of sides 18, of one of the sections 14, outwardly extending catches 26 being positioned at the extremities of lugs 24 as illustrated. At corresponding, appropriate locations in the other of the sections 14 are provided corresponding grooves 28 for catches 26. To facilitate the securing together of sections 14, guide channels 29 are provided in the walls of section 14 adjacent grooves 28, to facilitate the passage of the corresponding catch 26, on the other section 14, to groove 28. Lugs 24 are provided with some resiliency, and the outer surfaces of catches 26 are bevelled so that catches 26 will ride over the edges of the other section 14 and inner surfaces of sides 18 until they contact grooves 28, into which they will then spring in mated engagement. While this construction of interlocking means is a preferred one, because of its ability to minimize tampering, it will be understood that any other device of interlocking means, permanent or releasable, may be provided to the sections 14, appropriate to any given function or location in which the devices 6 may be used.

The sections 14 may be of any appropriate material, but are preferably of molded, rugged plastic. They may also be of any desired colour or colours, appropriate to a desired graphic design for fence 2.

When in position, as illustrated in FIG. 1, a plurality of plugs provide an attractive, highly visible graphic design for a fence which may significantly improve that fences appearance. While a design has been illustrated in FIG. 1, it is obvious that, alternatively, a plurality of devices 6 may be assembled on a fence 2 to provide written text, for example as a tool for corporate identification or to provide a relatively permanent, strongly visible indication of hazards which might exist behind a fence. Once in position, the sections provided with the interlocking means as described herein are extremely difficult to remove, minimizing the chance for vandalism or other devices of unwanted removal. Moreover, the devices in accordance with the present invention, when compared with previously noted prior art chain line fence attachments, are extremely simple to construct and install.

Figure 4:
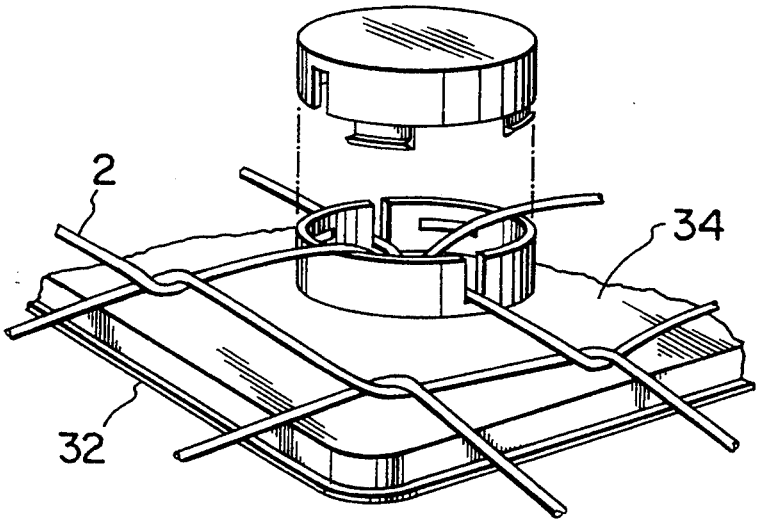
FIG. 4 is a perspective view of a portion of a fence to which a sign, to which devices in accordance with the present invention have been attached, is being secured.
Figure 5:
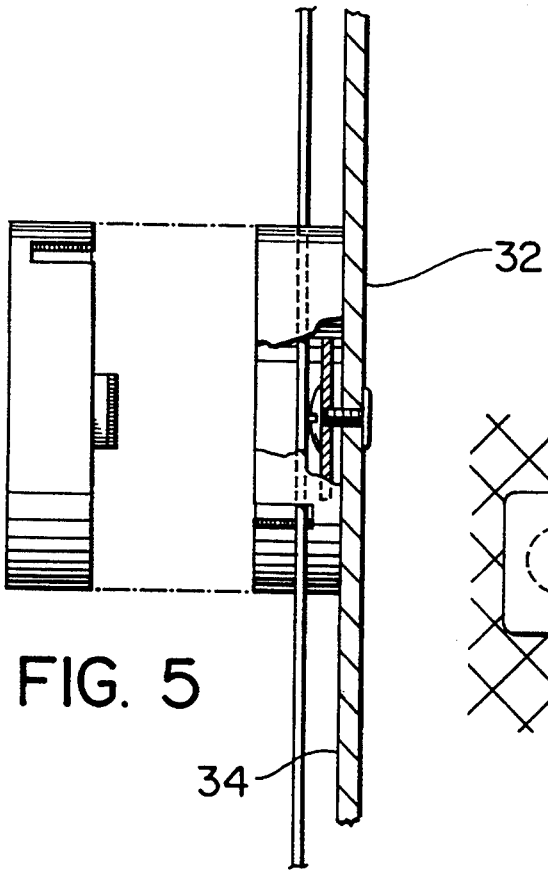
FIG. 5 is a side view, in partial section, of the sign and fence of FIG. 4.
Figure 6:
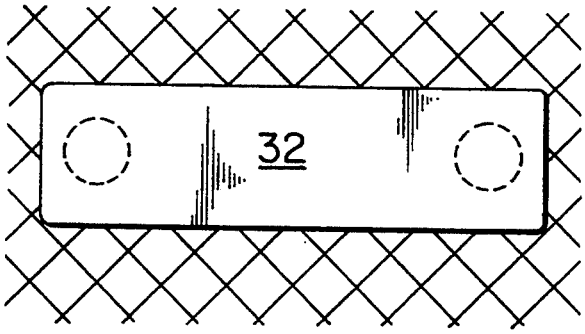
FIG. 6 is an elevation view, from the front, of a sign in accordance with the present invention mounted on a chain link fence.

Turning to FIG. 4 there is illustrated another application of devices 6 in accordance with the present invention, namely for securely attaching a sign 32 to a chain link fence. The sign is preferably made of rigid material such as aluminum, plastic, wood, laminated materials or the like. In particular, to the rear surface 34 of sign 32, at appropriate locations, a plurality of devices 6 are secured. (For smaller signs a single attachment device 2 may be all that is required.) One face 16 of one section 14 of each device 6 is secured to that rear surface by appropriate means which may be for example screws, nuts and bolts, rivets or adhesive, or the like. In the illustrated embodiment a screw/rivet attachment is the securing means (FIG. 5). The devices are located and oriented, when secured to the back surface of sign 32, as can be seen in FIG. 4, so that the cross-over center 12 of a corresponding portion of the fence is received within the interior of device 6, and wire lengths of corresponding portions of the fence are received in side slots 22 as illustrated. When the two co-operating sections 14 are interlocked together, for each device 6 on the back of sign 32, capturing between them portions of fence 2, the sign then becomes securely mounted and visible on the fence, as illustrated in FIG. 6.

In this manner, a sign may be readily and securely fastened, in an appropriate position, to a chain link or other such fence. Again, because of the construction of the devices 6, such signs are extremely difficulty to remove from the fence.

Thus it is apparent that there has been provided in accordance with the invention a system for attaching a sign to a chain link fence that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A system for attaching a sign to a chain link fence of the type having post-supported interwoven wires producing a matrix of wire lengths extending between wire cross-over centers, the system comprising one or more attachment devices, each comprising a pair of sections, each section having a face with circumscribing sides and interlocking means to secure the sections together along edges of their sides, the sections, when secured together over a cross-over center, producing a device with a hollow interior and having opposed faces with sides extending therebetween, the sides of the device having slots, when the device is so seated, located as to be seated over corresponding portions of the wire lengths extending outwardly from that center, the face of one of the sections of each of the devices being secured, by securing means, to a rear surface of sign.

2. A sign system according to claim 1 wherein the securing means are one or more items selected from the group comprising screws, nuts and bolts, rivets and adhesive.

3. A system according to claim 1 wherein the interlocking means are constructed and positioned so as to be within the hollow interior of the device to minimize tampering when the sections are secured together.

4. A system according to claim 3 wherein the securing means comprise a plurality of lugs, each lug extending from an interior surface of one of the sections, each lug having an extremity with a catch thereon, and a corresponding, catch receiving groove located on an inner surface of the other of the sections, for each lug.

5. A system according to claim 1 wherein the sections are of similar shape and are provided with circular faces and edges to produce, when secured together, a device having a cylindrical appearance.

6. A system according to claim 4 wherein the sections are of similar shape and are provided with circular faces and edges to produce, when secured together, a device having a cylindrical appearance.

7. A system according to claim 1 wherein the sides of each section are provided with a pair of slots positioned 180° from each other, the slots in one section being 90° offset from the slots in the other section when the sections are in position secured together.

8. A system according to claim 6 wherein the sides of each section are provided with a pair of slots positioned 180° from each other, the slots in one section being 90° offset from the slots in the other section when the sections are in position secured together.

9. A system according to claim 1 wherein the slots are of a depth such as to minimize lateral movement of the devices and sign when the sections are secured together in position over cross-over points on the fence.

10. A system according to claim 1 wherein a plurality of such devices is used to attach a sign, the sections being secured to the rear surface of the sign relative to each other so that so that each of the sections will receive within its interior a cross-over center of a corresponding portion of the fence and within its side slots wire lengths of corresponding portions of the fence, thereby to permit securing of the sign to the fence.

11. A system according to claim 1 wherein the sign is made of rigid material.

12. A system according to claim 10 wherein the sign is made of rigid material.

* * * * *